US010669747B2

(12) United States Patent
Yuan

(10) Patent No.: US 10,669,747 B2
(45) Date of Patent: Jun. 2, 2020

(54) SWING BOLT LOCK

(71) Applicant: Locway Technology Co., Ltd. (Dongguan Guangdong, CN), Dongguan (CN)

(72) Inventor: Mengxiao Yuan, Dongguan (CN)

(73) Assignee: Locway Technology Co., Ltd. (Dongguan, Guangdong, CN), Dongguan (CN)

( * ) Notice: Subject to any disclaimer, the term of this patent is extended or adjusted under 35 U.S.C. 154(b) by 407 days.

(21) Appl. No.: 15/675,394

(22) Filed: Aug. 11, 2017

(65) Prior Publication Data

US 2018/0051486 A1 Feb. 22, 2018

(30) Foreign Application Priority Data

Aug. 18, 2016 (CN) ..... 2016 1 0684039

(51) Int. Cl.

| | |
|---|---|
| ***E05B 17/22*** | (2006.01) |
| ***E05B 65/00*** | (2006.01) |
| ***E05B 47/06*** | (2006.01) |
| ***E05B 63/00*** | (2006.01) |
| ***E05B 17/20*** | (2006.01) |

(Continued)

(52) U.S. Cl.

CPC ..... *E05B 65/0075* (2013.01); *E05B 17/208* (2013.01); *E05B 17/2034* (2013.01); *E05B 47/0603* (2013.01); *E05B 47/0673* (2013.01); *E05B 63/0013* (2013.01); *E05B 65/0082* (2013.01); *E05B 47/0012* (2013.01); *E05B 47/06* (2013.01); *E05B 63/00* (2013.01); *E05C 3/00* (2013.01); *Y10T 292/1043* (2015.04); *Y10T 292/1082* (2015.04)

(58) Field of Classification Search

CPC ..... Y10T 292/1043; Y10T 292/1051; Y10T 292/1052; Y10T 292/1056; Y10T 292/1075; Y10T 292/1077; Y10T 292/1082; Y10T 292/1089; E05B 47/0603; E05B 47/0673

See application file for complete search history.

(56) References Cited

U.S. PATENT DOCUMENTS 3,040,555 A * 6/1962 Wartian ..... E05C 3/24 70/97
3,782,139 A * 1/1974 Rubner ..... E05C 1/16 70/81

(Continued)

FOREIGN PATENT DOCUMENTS

DE 2303226 A1 * 8/1974 ..... D06F 37/42

*Primary Examiner* — Carlos Lugo
(74) *Attorney, Agent, or Firm* — Wang Law Firm, Inc.

(57) ABSTRACT

A swing bolt lock includes a swing post, a cam dog, and an electric device cooperative with a lock bolt. The electric device includes a motor, a slider connected to a rotating shaft of the motor. Without an unlock authorization, the slider is situated in the space at an end of a sliding slot and abutted against the cam dog to prevent the cam dog from moving towards the space at the end of the sliding slot, so as to prevent the lock bolt from entering into the lock housing. With an unlock authorization, the slider is driven by the motor and released from the abutment of the cam dog, and the cam dog is driven by the lock bolt and swing post to enter into the space at the end of the sliding slot so as to release the locking of the lock bolt from turning into the lock housing.

18 Claims, 13 Drawing Sheets

(51) Int. Cl.
*E05B 47/00* (2006.01)
*E05C 3/00* (2006.01)

(56) References Cited

U.S. PATENT DOCUMENTS 4,703,960 A * 11/1987 Lense ..... E05B 47/0012 292/192
4,765,662 A * 8/1988 Suska ..... E05B 63/248 292/219
5,193,861 A * 3/1993 Juga ..... E05C 3/34 292/207
6,786,519 B2 * 9/2004 Gartner ..... E05B 17/2034 109/59 R
7,021,684 B2 * 4/2006 Orbeta ..... E05B 47/0046 292/201
7,461,872 B2 * 12/2008 Moon ..... E05B 17/2092 292/109
7,770,944 B2 * 8/2010 Yuan ..... E05B 47/0012 292/195
8,047,585 B1 * 11/2011 Peabody ..... E05B 47/0046 292/340
8,083,273 B2 * 12/2011 Yuan ..... E05B 47/0012 292/201
8,495,899 B2 * 7/2013 Gartner ..... E05B 47/0012 70/104
8,826,709 B2 * 9/2014 Dehaven ..... E05B 17/0062 70/333 R
9,617,755 B2 * 4/2017 Peabody ..... E05B 15/022
9,845,618 B2 * 12/2017 Worm ..... E05B 65/0075
10,145,156 B2 * 12/2018 Aker ..... E05B 47/0603
2008/0169657 A1 * 7/2008 Horton ..... E05B 83/30 292/220
2008/0303290 A1 * 12/2008 Yuan ..... E05G 47/0012 292/195
2008/0314100 A1 * 12/2008 Min ..... E05B 47/0012 70/278.1
2012/0180536 A1 * 7/2012 Miller ..... E05B 9/00 70/278.1
2013/0033045 A1 * 2/2013 Worm ..... E05B 65/0075 292/5
2016/0047148 A1 * 2/2016 Aker ..... E05B 47/0603 292/220
2016/0244995 A1 * 8/2016 Gartner ..... E05C 3/12

* cited by examiner

SWING BOLT LOCK

FIELD OF INVENTION

The present invention relates to the field of locks, in particular to a swing bolt lock.

BACKGROUND OF INVENTION

1. Description of the Related Art

In general, a dead bolt lock or a swing bolt lock is used as a locking device for safes or similar safe boxes. Compared with the locks of this sort and the door lock used at home or a room, both lock and open a door by the control of extending or withdrawing a lock bolt, and their difference reside on that the lock bolt of a door lock of a room has a blocking surface (or a force-receiving surface) parallel to a door panel, which is used for the control of locking and opening the door. The lock bolt of the dead lock or swing bolt lock used in the safe has a blocking surface (or a force-receiving surface) perpendicular to the door panel, which is not used for blocking or locking the door panel direction, but a pulling/blocking mechanism of the safe deposit box is controlled to close and open the door of the safe.

In U.S. Pat. Publication No. US2012/0180536 filed by the Lock II Company, a dead bolt lock used for a safe is disclosed, and the dead bolt lock comprises a dead bolt coupled to a gear set and a knob capable of engaging a gear, so that when no unlock authorization has been received, the knob is released from the engagement with the gear, and the rotation of the knob cannot retract the lock bolt. After a correct unlock password is inputted, the knob is engaged with the gear set. Now, the rotation of the knob can extend the lock bolt to the locked position and retract the lock bolt into the lock housing. The advantages of the dead bolt lock are listed below. The dead bolt lock has good mechanical strength, and large contact area between the force-receiving surface of the lock bolt and the notch of the lock housing notch, such that when a destructive impact occurs, the exerted force can be transmitted uniformly to the mounting screw of the lock housing, so that the dead bolt lock is capable of bearing a large destructive impact. Secondly, the square cam has two symmetrical force-receiving surfaces, so that regardless of the pulling/blocking mechanism of the safe being disposed at the top or the bottom, it is not necessary to adjust the lock installing position. The dead bolt lock used in a safe has a major drawback as described below. After the dead bolt lock is unlocked, the pulling/blocking mechanism of the safe pushes the lock bolt to the retracted position, and it is necessary to retract the lock bolt manually, and the conventional swing bolt lock has to overcome such drawback.

In U.S. Pat. Publication No. 20130033045 filed by Sargent and Greenleaf Incorporated, a used for a safe is disclosed, and the swing bolt lock comprises a fan-shaped lock bolt, a notch formed at the rear end of the lock bolt, an ejection lever installed at a position corresponsive to the notch and rotatable with respect to the axis, and a protrusion formed on a side of the ejection lever. At a locked position, a head of the ejection lever is embedded into the notch to block and prevent the lock bolt from retracting. After an unlock authorization is received, a motor drives and moves an actuator block sheathed on a lead screw to the protrusion of the ejection lever, so that after the ejection lever has rotated for an angle, the head of the ejection lever is separated from the notch of the lock bolt. Now, a pulling/blocking mechanism is operated to push the lock bolt into a lock housing. This patented technology uses the ejection lever as a blocking element to prevent the lock bolt from retracting. When the lock bolt receives a strong impact, the impact is transmitted directly to the ejection level with a small contact area with the lock bolt. Whether or not the mechanical strength of the ejection lever can bear the destructive impact is questionable.

In PCT/US2006/043879 filed by Klaus•W•Gartner, another swing bolt lock for a safe is disclosed. The technical solution of this technology has been used in the Lagard's swing bolt lock available in the market. Such swing bolt lock includes a cam coupled to a rotating solenoid, and the assembly of the cam includes a rotating disc and a tab, and an accommodating slot is formed at an edge of the lock bolt for accommodating the tab. At a locked position, the tab enters into the accommodating slot to block and prevent the lock bolt from rotating towards the housing. After an unlock authorization is received, the motor is controlled to rotate the cam, so that the rotating disc is rotated, and the tab is separated from the accommodating slot of the lock bolt to release the blocking of the lock bolt. Now, a handle of the pulling/blocking mechanism is rotated, so that the lock bolt is no longer pushed into the lock housing. Since the tab is relatively thinner and the accommodating slot is relatively smaller, therefore to reduce the impact on the tab and the cam, teeth are formed on a side of the notch of the lock housing notch and at position at the edge of the side corresponsive to the lock bolt and engaged with one another. In the meantime, the axis of the lock bolt is designed as a flexibly biased axis. When there is a strong unauthorized unlock, the axis of the lock bolt is biased by an external force, so that the teeth at the edge of the lock bolt are engaged with the teeth on the notch of the lock housing, and a part of the external force is transmitted to the lock housing.

To improve the protection performance of the safe deposit box, some swing bolt locks have a relocking mechanism. For example, U.S. Pat. No. 8,826,709 filed by Kaba Mas Company discloses a relocking mechanism of a swing bolt lock, and the relocking mechanism comprises two biasing elements latched to a lock cover and one of the biasing elements being formed by bending a wire and disposed in one of the perpendicular slots, a column disposed nearby, and the biasing element having an end latched to an end of the lock bolt and the other end latched to a wire threading hole of the lock housing, a section of a weaker guard slot formed at a position of the lock cover proximate to the lock bolt, and the biasing element spanning over the guard slot. In general, an external attach aims at the boring hole at the position of the wire threading hole, where there is no protection by anti-boring steel plate, and a door panel and the lock housing may be bored easily, and the lock may be attacked by an impact of a tool such as a hammer at the hole. Now, the force of the hammer falls on the lock cover. After the destructive impact is imposed on the lock cover, the lock cover will break along the weaker guard slot, so that the biasing element will fall out from an end near the wire threading hole, and the biasing element releases the elasticity, so that the other end of the biasing element latched to the end of the lock bolt will relock the lock bolt. In the meantime, the hammer loses its focus and no longer can damage other parts of the lock. Since the lock bolt is still situated at the locked position, and the door of the safe deposit box is not opened yet, therefore the safe deposit box can be protected. Regrettably, the swing bolt lock equipped with the relocking mechanism can be installed by attaching the lock housing to the door panel, and the focus of the hammer can be aimed at the lock housing if the lock cover attached onto the door panel is bored, and the lock housing is thicker than the lock cover, and there is no guard slot. Therefore, the lock bolt may be separated and the door of the safe deposit box can be opened easily when a large shock or impact is applied to damage the lock housing.

Since the swing bolt lock for a safe deposit box just has one blocking surface (or force-receiving surface), therefore some swing bolt locks need to be installed on the opposite side for the safe deposit box including a latch mechanism installed at a specific position. In some of the foregoing patented swing bolt locks and other conventional swing bolt locks, the option of installing the lock on the opposite side is no provided (since there are only three mounting holes). Although some of the swing bolt locks provide the installation of the lock with the door panel on both sides (since there are four mounting holes), yet the key components inside the lock are not symmetric structures. As a result, the defensibility and impact resistance of the lock have a larger difference. If a side with a weaker strength is attached onto the door panel for the installation, the performance of resisting destructive impact will be reduced significantly.

In summation, the conventional swing bolt lock structure requires further improvements on the safety protection performance.

2. Summary of the Invention

Therefore, it is a primary objective of the present invention to provide a symmetrical structure of a high-reliability high-security swing bolt lock capable of uniformly scattering and transmitting the impact imposed on the lock bolt to the housing for a free installation on both sides and in eight directions without changing the impact resistance.

To achieve the aforementioned and other objectives, the present invention provides a swing bolt lock, comprising: a housing with at least one first opening, including a first casing, a second casing, a lock bolt capable of turning out from the first opening to a locked position and turning to an unlocked position, a locking device capable of controlling and stopping the lock bolt from turning out from the locked position to the unlocked position, and a first elastic element capable of restoring the lock bolt from the unlocked position to the locked position, characterized in that the locking device comprises: a swing post, a cam dog, an electric device, a first basin formed in the housing and capable of accommodating the swing post and allowing the swing post to be rotated therein, a first shaft slot and a second shaft slot formed on the swing post, a first bolt shaft installed onto the lock bolt and configured to be corresponsive to the first shaft slot, and a cam dog shaft installed onto the cam dog and configured to be corresponsive to the second shaft slot; the electric device comprises: a motor, a slider coupled to a transmission shaft of the motor, received in the sliding slot inside the housing and capable of sliding in the sliding slot, wherein, the slider at the locked position is situated in the space at an end of the sliding slot and abuts against the cam dog to stop the lock bolt from turning into the housing; after an unlock authorization is received, the motor drives the slider to be separated and to abut against the cam dog, and after an external force is exerted onto the lock bolt, the swing post is pushed, and the swing post further pushes the cam dog, so that the cam dog is turned into the space at an end of the sliding slot, and the lock bolt is turned to the unlocked position.

Further, the swing post comprises two coaxial symmetrical cylinders, a beam coupled to the two cylinders, and a second opening formed between the two cylinders and capable of accommodating a part of the lock bolt and a part of the cam dog, and the first shaft slot and the second shaft slot are parallelly disposed on the cylindrical surfaces of the two cylinders respectively, and the first bolt shaft is symmetrically installed on the two planes of the lock bolt, and the cam dog is in the shape of a partial ring body, and the cam dog shaft is symmetrically installed on the two planes of the ring body.

Further, the beam is installed at a position deviated from the center of the cylinder, and the joint surface of the beam and the cylindrical surface of the two cylinders and the cylindrical surface of the two cylinders are disposed on the same cylindrical surface, and the beam has a length greater than the thickness of the lock bolt, and the cam dog has a thickness equal to the thickness of the lock bolt.

Preferably, the first shaft slot and the second shaft slot are semicircular slots, and the first shaft slot and the second shaft slot on the cylindrical surface of the swing post have an angular difference from 170 degrees to 190 degrees.

Further, the cam dog includes a cam dog head and a downwardly curved cam dog tail, and when the lock bolt is situated at the locked status, the cam dog head and the slider head abut against each other and the cam dog further includes a first flange formed inside the housing and abutting against the cam dog tail.

Further, the lock bolt has a protruding arc strip symmetrically disposed on the two planes of the lock bolt separately, and the swing post has a recessed arc surface disposed at a corresponding position configured to be corresponsive to the arc strip.

Preferably, the lock bolt is fan-shaped, and the included angle of the fan shape is 80 degrees to 100 degrees, and the lock bolt has a first axial hole, and the housing has a first bolt shaft slidably coordinated with the first axial hole, and the first elastic element is a bias spring sheathed on the first bolt shaft, and the bias spring has an end fixed to a second flange in the housing, and the other end fixed to a neck at an end of the lock bolt.

Further, the bias spring includes two symmetrically installed coil springs respectively: a first coil spring and a second coil spring integrally formed as a whole, and outer ends of the first coil spring and second coil spring are extended along the tangent of the coil springs and then bent into a hook which is a first hook of the second flange, and inner ends of the first coil spring and second coil spring are extended along the tangent of the coil springs and then bent into a right angle to for a second hook, and the distance between the inner sides of the first coil spring and second coil spring can accommodate the thickness of the lock bolt.

Further, the swing bolt lock comprises symmetric first openings, first basins and sliding slots disposed in the first casing and second casing and also comprises symmetric lock mounting holes formed in the first casing and second casing.

Preferably, the first casing and the second casing have the same thickness.

Further, the swing bolt lock further comprises identical lock mounting holes formed at the four corners of the first casing and second casing respectively, and the lock mounting hole have the same sink hole, so that any one of the two sides of the lock may be selected to be installed and contacted with the door panel.

Further, the swing bolt lock comprises a fifth lock mounting hole formed at positions of the first casing and second casing respectively and disposed at positions proximate to the first basin.

Further, the first casing has at least two circular truncated cone shaped convex stop openings coaxially arranged with the lock mounting holes, and the second casing has a circular truncated cone shaped concave stop opening formed at a position corresponsive to the circular truncated cone shaped convex stop opening.

Further, the swing bolt lock comprises a ring-shaped lead slot formed at the motor and disposed around the circular truncated cone shaped convex stop opening.

Further, the swing bolt lock comprises a symmetric guard slot formed at the first casing and the second casing, and a portion of the housing with the guard slot is broken first when the housing is damaged by external forces, and the swing bolt lock further comprises a relocking device, and the relocking mechanism includes a second elastic member, and a third notch formed on the swing post and configured to be corresponsive to the second elastic member, and when the housing is damaged, the second elastic member enters into the third notch to block and prevent the swing post from rotating when a portion of the housing sealed by the guard slot is cracked.

Further, the swing bolt lock further comprises a third flange formed in the guard slot of the second casing, a cam dog shaft installed outside the guard slot of the second casing, and a location hole formed at a position proximate to the cam dog shaft, and the second elastic member comprising a third coil spring, a stop portion, an extension, and a free end of the third coil spring and a free end of the extension, and the third coil spring being sheathed on the cam dog shaft, and the free end of the third coil spring being fixed to the location hole, and the hook at the free end of the extension being disposed on the third flange to deviate the third coil spring, and the stop portion is configured to be corresponsive to the third notch of the swing post.

Further, the second elastic member is a whole piece made of a spring wire, and the stop portion is in a U-shape, and the free end of the extension is an L-shaped hook, and the cross-sectional shape of the third flange is an inverted L-shaped hook latched with the L-shaped hook, and the housing has a boss configured to be corresponsive to the third coil spring for limiting the axial movement of the third coil spring.

Further, the swing bolt lock further comprises a position switch provided for detecting a rotational entrance or exit of the lock bolt, and an elastic contact arm of the position switch elastically touches and presses a beam of the swing post, and when the lock bolt is turned into a position, the elastic contact arm is separated from the beam to change an ON/OFF electrical signal.

Compared with the prior at, the present invention has the following advantages:

1. The structure of the swing post and the cam dog operated with the rotation of the lock bolt increases the force-receiving surface between different components, and such arrangement not just provides a stable operation of the locking device only, but also decomposes and transmits the external force exerted by the lock bolt to a more solid and firmer part of the housing by the arc surface contact, so as to enhance the impact resistance of the swing bolt lock and improve the overall safety performance of the swing bolt lock.

2. In the present invention, the swing post, the cam dog and the lock housing and their mounting hole, and relocking mechanism are symmetric structures, so that no mater which surface of the lock is contacted and installed with the door panel, the impact resistance and defensibility are not affected, so as to enhance the safety, reliability and adaptability of the lock.

3. Compared with the D-shaped lock bolt, the volume of the lock bolt of the present invention is smaller to save the internal space of the lock.

4. The present invention has the features of simple structure, small number of components, and compact electromechanical connection.

DESCRIPTION OF THE PREFERRED EMBODIMENTS

Figure 1:
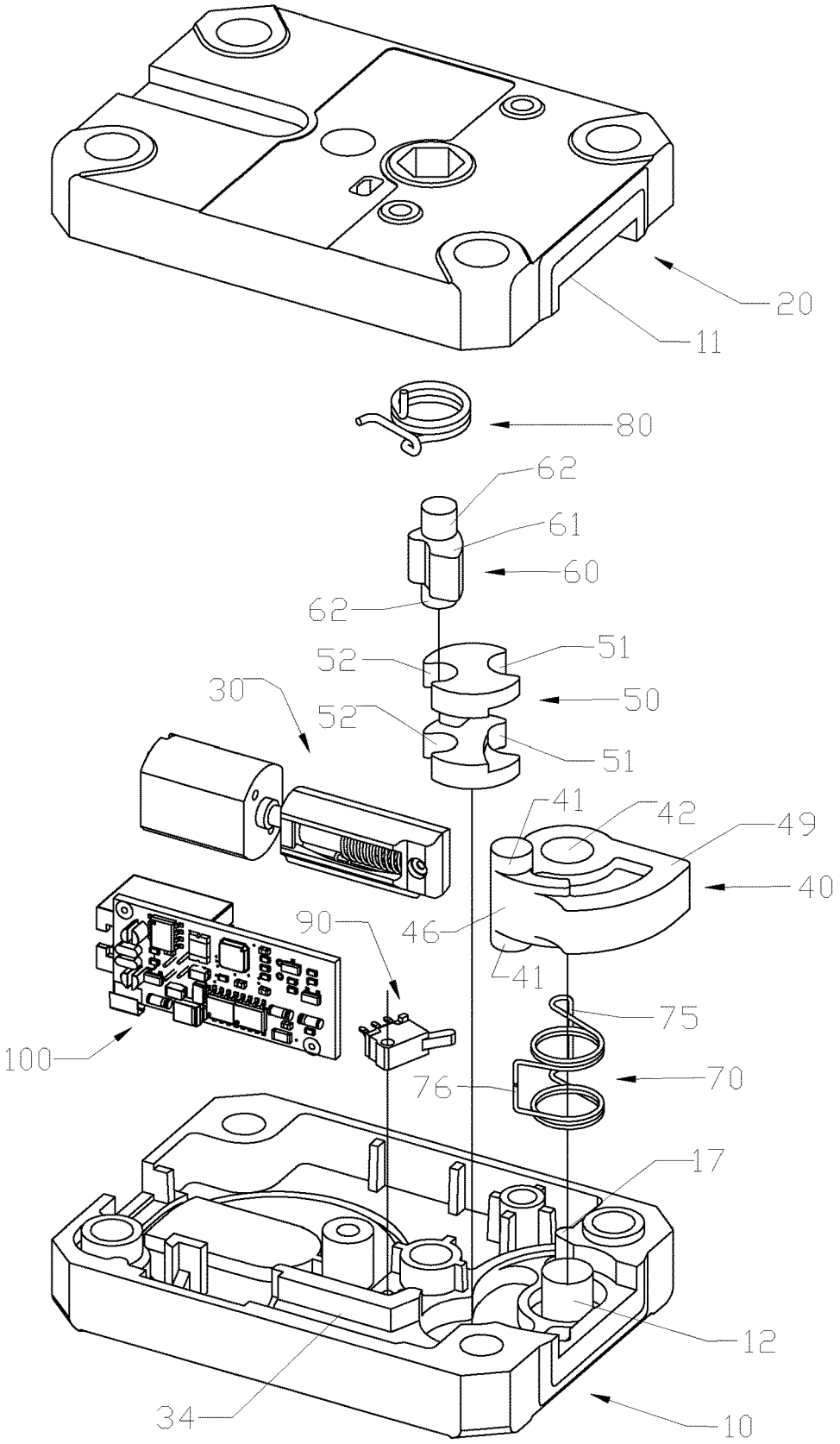
FIGS. 1 and 2 are exploded views of a preferred embodiment of the present invention viewing from two different angles respectively.

The above and other objects, features and advantages of this disclosure will become apparent from the following detailed description taken with the accompanying drawings.

With reference to FIGS. 1 to 4 for the structure of a swing bolt lock in accordance with a preferred embodiment of the present invention, the swing bolt lock comprises a first casing 10 and a second casing 20, and also comprises a lock bolt 40, a first elastic element (which is the bias spring 70), a swing post 50, a cam dog 60, an actuator assembly 30 and a circuit board 100, and the lower half portions of these components are installed in the first casing 10. After the first casing 10 and the second casing 20 are combined, the upper half portions of these components are installed in the second casing 20. The first axial hole 42 of the lock bolt 40 is sheathed on the first bolt shaft 12 in the first casing 20, and the lock bolt may be turned around the first bolt shaft 12 within a range of approximately 90 degrees, and the front surface 49 (which is also the force-receiving surface) of the lock bolt may be turned from the locked position into the first opening 11 of the housing, or turned out from the first opening 11 to the locked position. The first bolt shaft 41 on the lock bolt is installed near a lock bolt end 46, and whose axis is a specific distance from the axis of the first axial hole of the lock bolt 40, and the first bolt shaft 41 is extended outwardly from two planes of the lock bolt 40 and engaged with the two symmetrically installed first shaft slots 51 on the swing post 50, and the two symmetrically installed second shaft slots 52 on the swing post 50 are engaged with the two symmetric cam dog shafts 62 on the cam dog 60. After the lock bolt 40, the swing post 50, and the cam dog 60 are assembled, a portion of the lock bolt 40 and a portion of the cam dog 60 are situated in the second opening 53 of the swing post 50. The bias spring 70 has a first hook 75 hooked onto a second flange 17 of the housing, and a second hook 76 latched to a neck 44 of the lock bolt. A third coil spring 81 of a second elastic member 80 of the relocking mechanism is sheathed on a cam dog shaft 37 of the second casing 20. The actuator assembly 30, a circuit board 100 and a position switch 90 are installed at corresponding positions o the housing.

Figure 3:
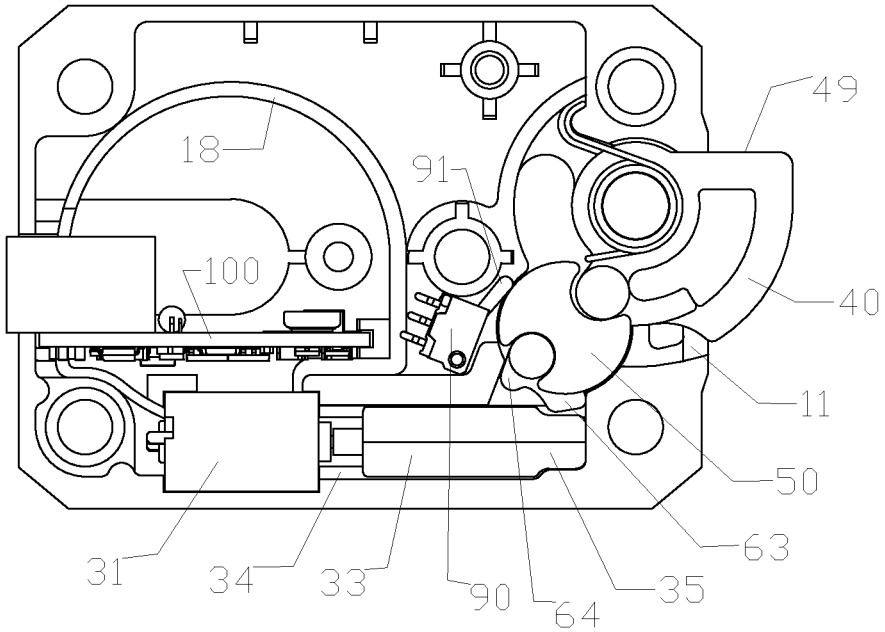
FIGS. 3 and 4 are schematic views of a swing bolt lock (with a second casing removed from the swing bolt lock) situated at a locked status and an unlocked status in accordance with preferred embodiment of the present invention respectively.
Figure 4:
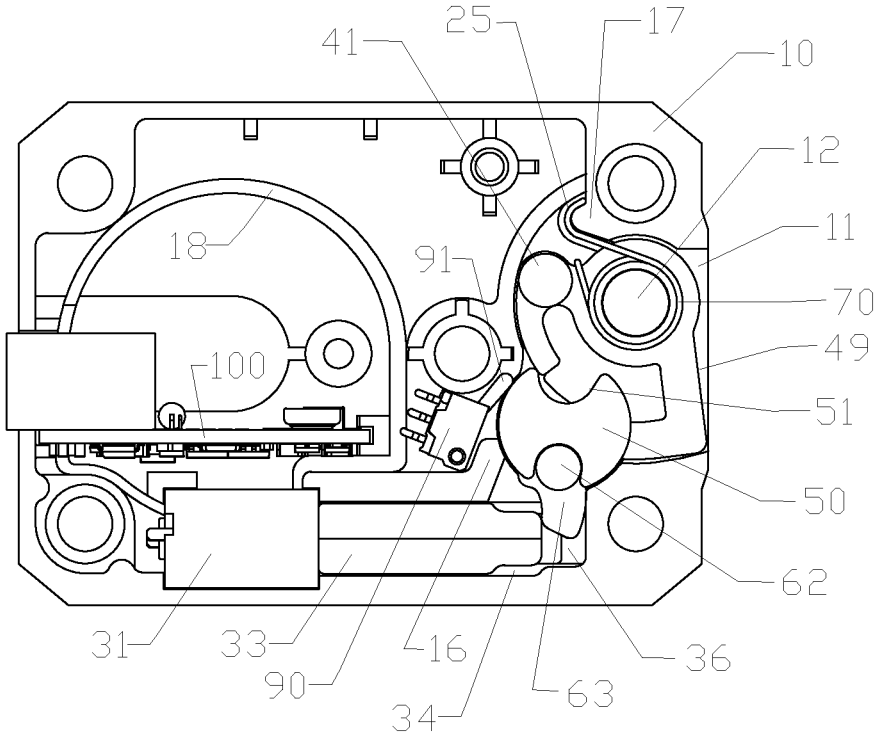

In FIGS. 3 and 4, the actuator assembly 30 comprises a motor 31, and a slider 33 coupled to the motor 31 and driven by the motor 31 to slide in the sliding slot 34, and a slider head 35 is disposed under the cam dog 60. At a locked status, the slider head 35 is situated at a sliding slot end 36 and abuts against the cam dog head 63. Without receiving an unlock authorization, if the handle is rotated to turn the lock bolt 40 into an unlocked position, the slider 33 does not slide in a direction towards the motor 31 but still occupies the position at the sliding slot end 36 and abuts against the cam dog head 63, so that the cam dog 60 cannot be rotated downwardly, and the swing post 50 cannot be rotated, so as to achieve the effect of locking the lock bolt 40. If the unlock authorization (or a correct unlock password) is received, the motor 31 will drive the slider 33 to slide towards the motor 31, and the slider head 35 is separated from the abutment with the cam dog head 63 to provide a space at the sliding slot end 36. Now, the rotation of the handle can drive the lock bolt 40 to rotate clockwise from the locked position to the unlocked position. In the meantime, the first bolt shaft 41 transmits such action force to the first shaft slot 51 to push the swing post 50 to rotate counterclockwise, so that the second shaft slot 52 drives the cam dog shaft 62 of the cam dog 60 to rotate counterclockwise, so that the cam dog head 63 enters into the space at the sliding slot end 36, and the lock bolt is retracted into the first opening 11 of the lock housing. At an unlocked status, the external force of the lock bolt is released after the unlocking process ends, and the bias first elastic element (bias spring 70) rotates the lock bolt 40 from the unlocked status to the locked status. In the meantime, the first bolt shaft 41 is guided by an arc strip 47 protruded from a plane of the lock bolt to slide into the first shaft slot 51. When the first bolt shaft 41 is pushed, the swing post 50 rotates clockwise, and the second shaft slot 52 drives the cam dog shaft 62 of the cam dog 60 to rotate counterclockwise, and the cam dog head 63 is retracted from the sliding slot end 36. Now, the motor 31 is rotated in the opposite direction by electricity to push the slider 33 to enter into the sliding slot end 36, and the slider head 35 abuts against the cam dog head 63 again to enter the swing bolt lock into the locked status.

Figure 5:
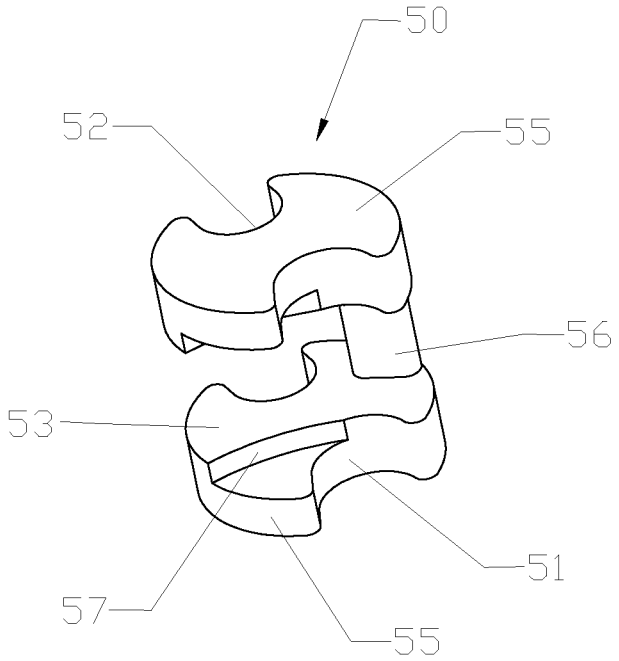
FIG. 5 is a perspective view of a swing post of the present invention.
Figure 6:
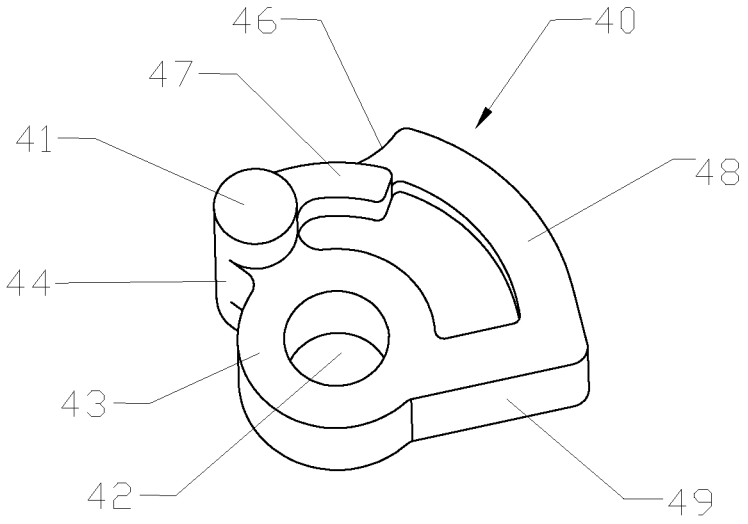
FIG. 6 is a perspective view of a lock bolt of the present invention.
Figure 7:
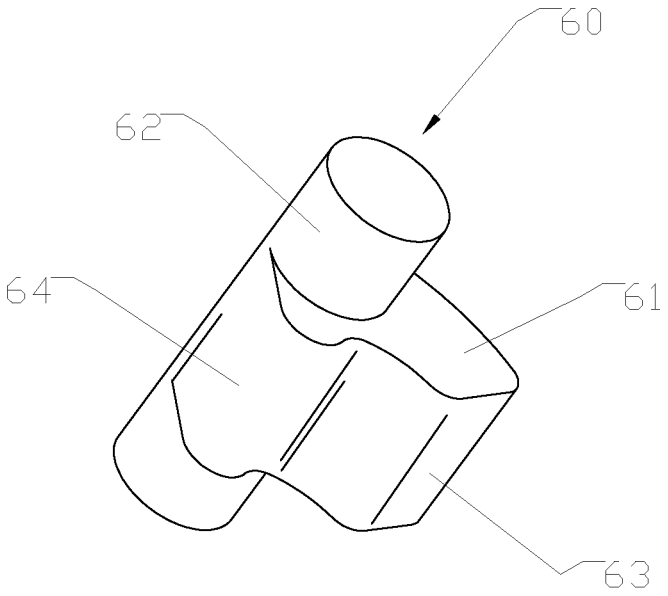
FIG. 7 is a perspective view of a cam dog of the present invention.

With reference to FIGS. 5, 6 and 7 for the structure of the swing post 50, lock bolt 40 and cam dog 60, the swing post 50 is formed by connecting a beam 56 and two symmetric cylinders 55, and the beam has a length slightly greater than the thickness of the lock bolt 40, and its position is deviated towards a side which is equivalent to a long hollow cylinder with a small portion carrying a portion of the cylindrical surface, and the space at the middle of the swing post is the second opening 53 for accommodating a portion of the lock bolt and cam dog. The first shaft slot 51 and second shaft slot 52 of the swing post 50 look like a hemisphere with a semicircular arc extended slightly outward. The first shaft slot 51 and the second shaft slot 52 are basically designed to be symmetrical. In other words, the first shaft slot 51 and the second shaft slot 52 on the cylindrical surface of the swing post 50 have an angular difference approximately equal to 180 degrees. Obviously, the first shaft slot 51 and the first bolt shaft 41, and the second shaft slot 52 and the cam dog shaft 62 have a sliding cooperative relationship. The external cylindrical surface of the swing post 50 is disposed in a first basin 13 in the housing, and the basin is in a circular disc shape, and its inner wall is slidably cooperative with the cylindrical surface of the two cylinders of the swing post. The cam dog 60 includes a cam dog body 61 and two symmetric cam dog shafts 62, and the cam dog body 61 has a thickness equal to the thickness of the lock bolt 40 and a shape of the partial ring body (approximately a quarter of the ring), and the cam dog shaft 62 is extended outwardly from the planes on both sides of the cam dog body 61 and cooperative with the two second shaft slots 52 of the swing post 50. The cam dog 60 further comprises a cam dog head 63 and a downwardly bent cam dog tail 64, and a first flange 16 is formed at a position corresponsive to the first casing 10 and abutted against the cam dog tail 64. When the cam dog 60 is situated at the locked position, the flange 16 abuts the cam dog 60 to stop and prevent the cam dog 60 from rotating clockwise, so that the cam dog head 63 will not hinder the slider head 35 from entering into the sliding slot end 36. When the lock bolt 40 is situated at the locked position, the peripheral portion of the first bolt shaft 41 of the lock bolt is disposed precisely at the upper half of the second opening 53 of the swing post 50, and the cam dog 60 is disposed at the lower half of the second opening 53 of the swing post 50. Since the end of the lock bolt 40 and the protruding arc strip 47 of the lock bolt enter into the second opening 53 of the swing post during the unlocking process, and the cam dog 60 has moved to the position of the sliding slot end 36 already, therefore the lock bolt 40 in the second opening 53 has no interaction with the cam dog 60.

With reference to FIG. 6 together with 1 and 2, the lock bolt 40 is substantially fan shaped, and the fan shape has an included angle substantially smaller than 90 degrees. Compared with the conventional D-shaped lock bolt, the size is reduced significantly. With the same lock shape and size, a bigger space is provided in the housing to facilitate the installation of more components and functions. In the figures, the lock bolt includes two planes 48, a lock bolt front surface 49, a bolt hub 43 and a lock bolt end 46. The lock bolt front surface 49 is a blocking surface which is a force-receiving surface. A recessed lock bolt neck 44, is provided between the of first bolt shaft 41 of the lock bolt 40 and the bolt hub 43 for fixing the second hook 76 of the bias spring 70. On a plane of the lock bolt 40, there are two symmetrical hollow areas provided as a measure to reduce the weight of the lock bolt 40 without affecting the mechanical strength. A protruding arc strip 47 is symmetrically disposed on two planes of the lock bolt 40, and a recessed arc surface 57 disposed on a relative position of the swing post 50 and cooperative with the arc strip 47, and the arc strip 47 is slidably cooperative with the arc surface 57. When the swing post 50 rotates with the lock bolt 40 to provide a rail guide effect, the swing post rotates stably, and when the lock bolt 40 is rotated all the way, and the first shaft slot 51 of the swing post 50 is separated from the first bolt shaft 41 of the lock bolt 40, the cooperative structure can prevent the swing post 50 from moving.

Figure 8:
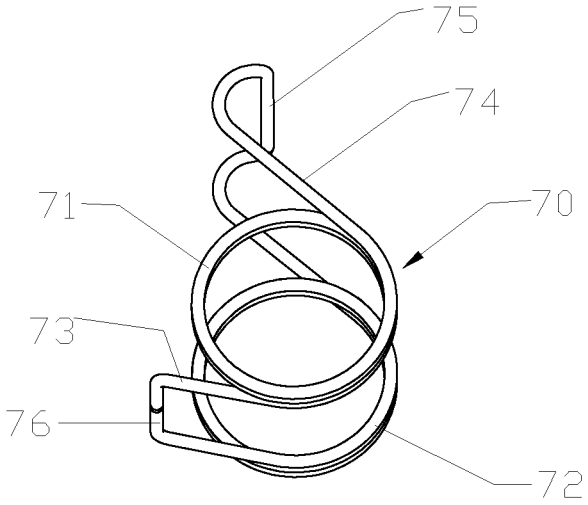
FIG. 8 is a perspective view of a first elastic member of the present invention.

With reference to FIG. 8 for a first elastic element which is the structure of a bias spring, and the bias spring 70 is comprised of two identical coil springs formed by winding a spring wire. In other words, an outer end 74 of the symmetrical first coil spring 71 and second coil spring 72 is bent into a first hook 75, and an inner end 73 are bent inwardly for 90 degrees to form a second hook 76, and the distance between the inner sides of the first coil spring 71 and second coil spring 72 is slightly greater than the thickness of the lock bolt 40 to facilitate clamping the lock bolt therebetween. Obviously, the second hook 76 is in the shape of a half rectangular frame with two parallel vertical edges attached onto a plane of the lock bolt 40, and a horizontal edge latched to the lock bolt neck 44. Two vertical edges of the outer end of the first hook 75 are bent into a semicircular arc and then the horizontal edge is bent, and such semicircular arc matches precisely with the shape of the second flange 17 at the corresponding position of the housing. A predetermined angle is defined by the first hook 75 and second hook 76 when they are in the free status and situated at the position of the bias spring 70. After the bias spring 70 is installed, the angle is reduced, so that the bias spring 70 applies a counterclockwise rotating force (in the locking direction) to the lock bolt 40.

Figure 9:
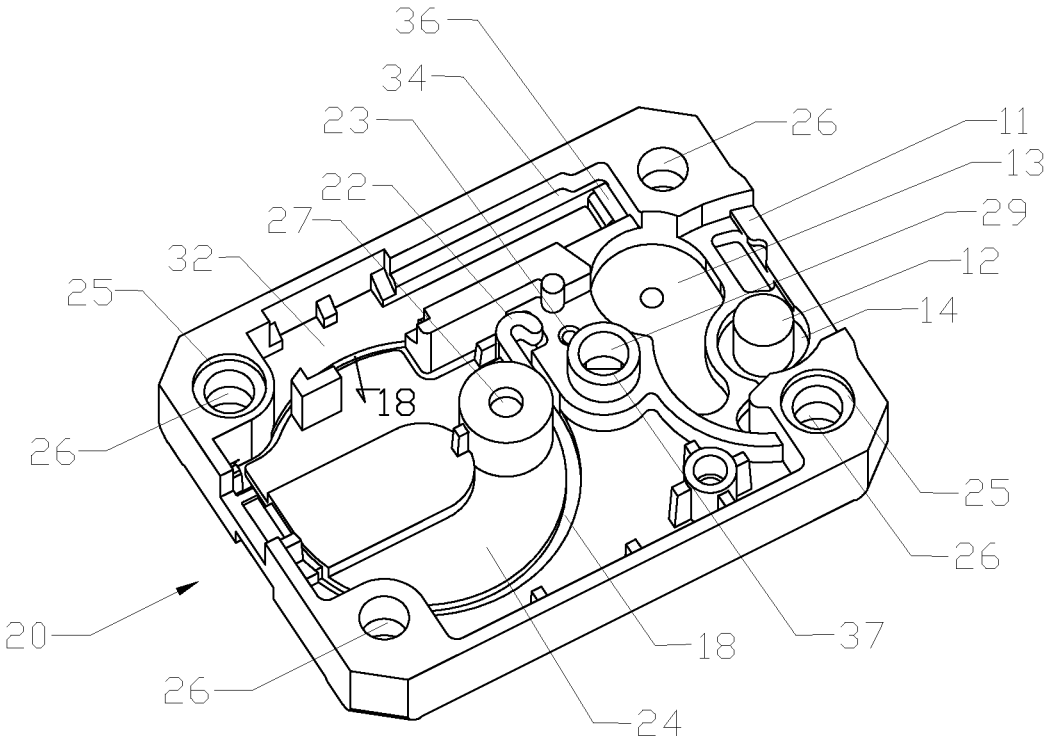
FIG. 9 is a perspective view of a second casing of the present invention.
Figure 10:
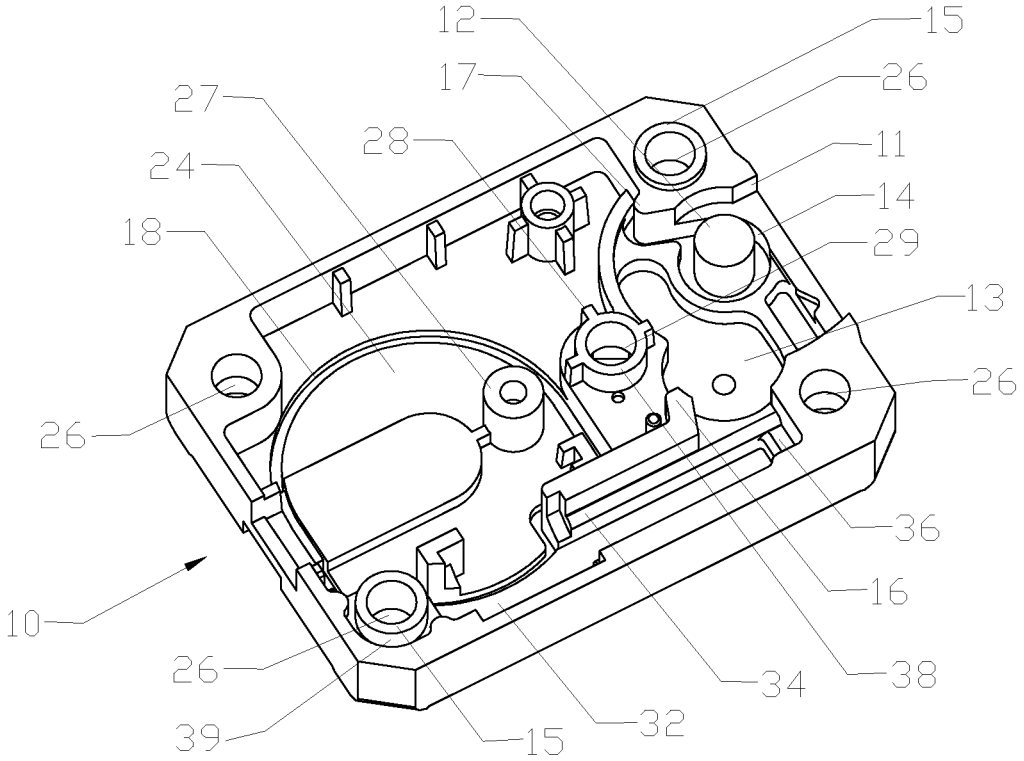
FIG. 10 is a perspective view of a first casing of the present invention.

With reference to FIGS. 9 and 10 for the structure of the second casing 20 and the first casing 10 in accordance with a preferred embodiment of the present invention, the housing is divided into two equal parts by its thickness, and the second casing 20 and the first casing 10 basically have the same appearance, and their internal structures are basically symmetrical and cooperative. For example, the cavity 32 for installing the motor 31, and the sliding slot 34 and sliding slot end 36 for disposing the slider 33, the first opening 11, the first bolt shaft 12, and the first basin 13 are symmetrical structures. After the second casing 20 and the first casing 10 are combined, a whole cavity or space of any other shape is formed. For example, the second casing 20 and the first casing 10 are combined to form the first basin 13 which is a cylindrical cavity matched with the swing post 50. After the second casing 20 and the first casing 10 are combined, the first opening 11 is formed into a rectangular shape matched with the lock bolt 40, and so on. The guard slots 18 symmetrically formed on the second casing 20 and first casing 10 do not form the cavity, and their effect is to seal a portion of the housing, so that a portion of the housing 24 will be damaged and cracked or separated from other portions of the housing, when the lock is attacked by an external force. As a result, the unauthorized person will be unable to apply forces to damage other important parts of the lock from the front side of a door, and the lock still remains at the locked status.

With reference to FIGS. 9 and 10, two casings are combined by a stop positioning method. Specifically, the two mounting holes 26 of the first casing 10 situated at the diagonal positions are coaxially arranged circular truncated cone shaped convex stop openings 15, and two identical mounting holes of the second casing 20 situated at the diagonal positions are also coaxially arranged circular truncated cone shaped concave stop openings 25 (or vice versa, wherein the second casing has the convex stop openings, and the first casing has the concave stop openings), so as to ensure an accurate positioning result of the two casings.

In addition, the second casing 20 and the first casing 10 have screw holes 27 and their sink holes respectively, and the first bolt shaft 12 has a first ring slot 14 formed at the periphery of the root of the first bolt shaft 12 for accommodating the first coil spring 71 and the second coil spring 72 of the bias spring 70, so that the bias spring 70 has a better positioning. Around the periphery of the circular truncated cone shaped convex stop opening 15 near the cavity 32 for installing the motor in the first casing 10 has a ring-shaped lead slot 39 for fixing the lead of the motor in order to overcome the problem of fixing the lead of the motor and prevent electrical conduction through the lead of the motor when the lock is attacked. In addition, the first flange 16 cooperative to the cam dog tail 64 and the first hook 75 cooperative with the bias spring 70 in the first casing, and the second flange 17 in the two casings are designed to receive force uniformly. In this embodiment, the mounting holes 29 near the first basin and in the second casing 20 and the first casing 10 are designed to be two sections of a circular pipe, and the circular pipe of the second casing 20 is designed into a cam dog shaft 37, and the external cylinder of the first casing is designed as the third shaft 38.

Figure 11:
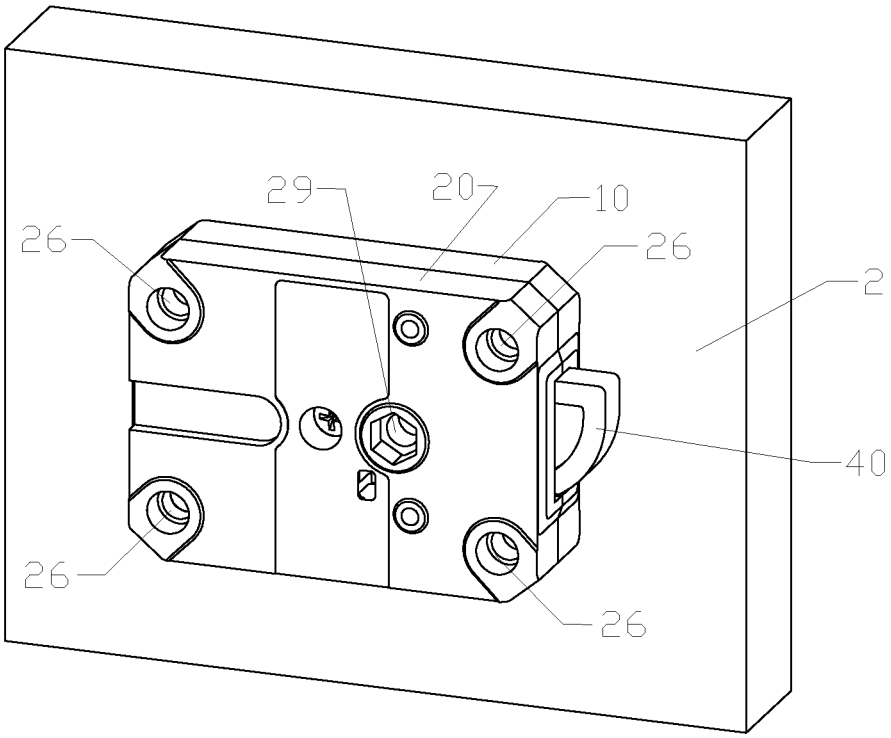
FIGS. 11 and 12 are perspective views of a swing bolt lock being installed onto the front and back sides of a door panel in accordance with the present invention respectively.
Figure 12:
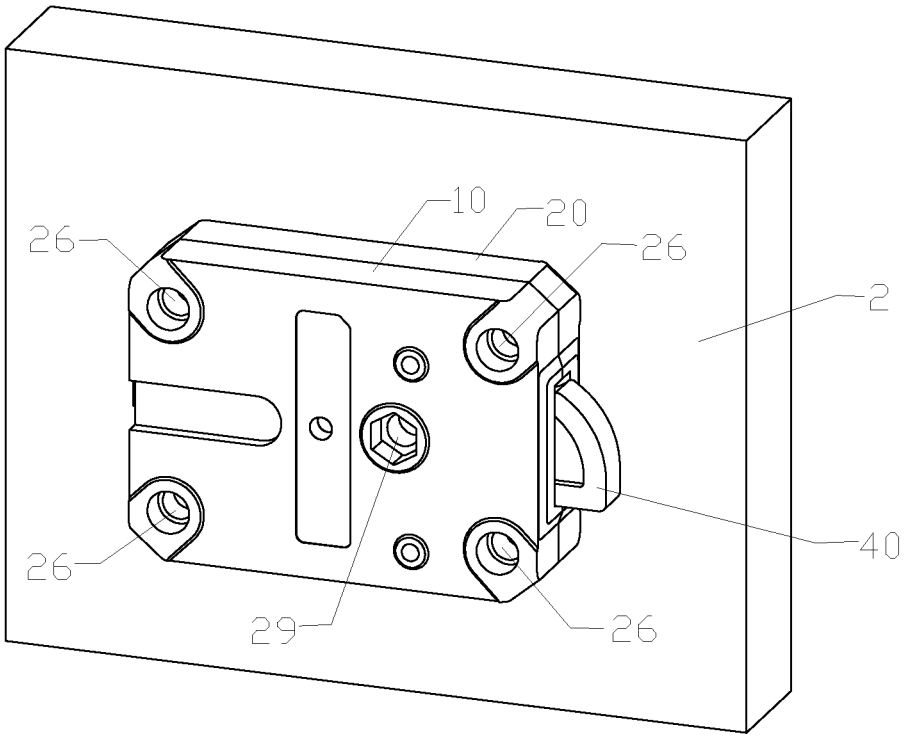

With reference to FIGS. 11 and 12 for installing the swing bolt lock onto a door panel 2 in accordance with a preferred embodiment of the present invention, the installation is the same as other locks, and every lock requires a mounting hole formed on the door panel for installing the lock. In FIGS. 11 and 12, this preferred embodiment has five lock mounting holes, wherein four of the lock mounting hole 26 are disposed at four corners of the housing respectively, and the remaining one is the fifth lock mounting hole 29 coaxially arranged with respect to the cam dog shaft 37 and the third shaft 38. As to the installation of the lock to the door panel, the five lock mounting holes not just improves the way of installing the swing bolt lock only, but also enhances the resistance for destructive impacts; particularly, for the mounting hole 29 proximate to the lock bolt. When the lock housing receives a large destructive impact, and even if the second half of the lock have been damaged, the first half of the lock is fixed by three mounting screws, so that its mechanical strength exceeds the mechanical strength of the lock, and the lock will not be separated by the damage of the second half of the lock. In addition, the second half of the lock is damaged and separated, so that the destructive force loses its focus and cannot continue damaging the first half of the lock, and the lock bolt 40 still remains in the locked status to ensure that the door of the safe deposit box cannot be opened. Compared with the conventional swing bolt lock having three mounting holes, the present invention further has an advantage to facilitate users to replace the lock. Since there are holes at the four corners of the housing, the swing bolt lock of the present invention can be installed to the original position (regardless of which side of the lock is attached to the door panel). Therefore, the lock can be installed freely form both sides and eight different directions to the door panel 2 of a safe deposit box. Regardless of which installation direction, the lock as the same capability of resisting destructive attack. In other words, the destructive impact resistance of the lock will not be affected by the installation method of the lock.

Figure 2:
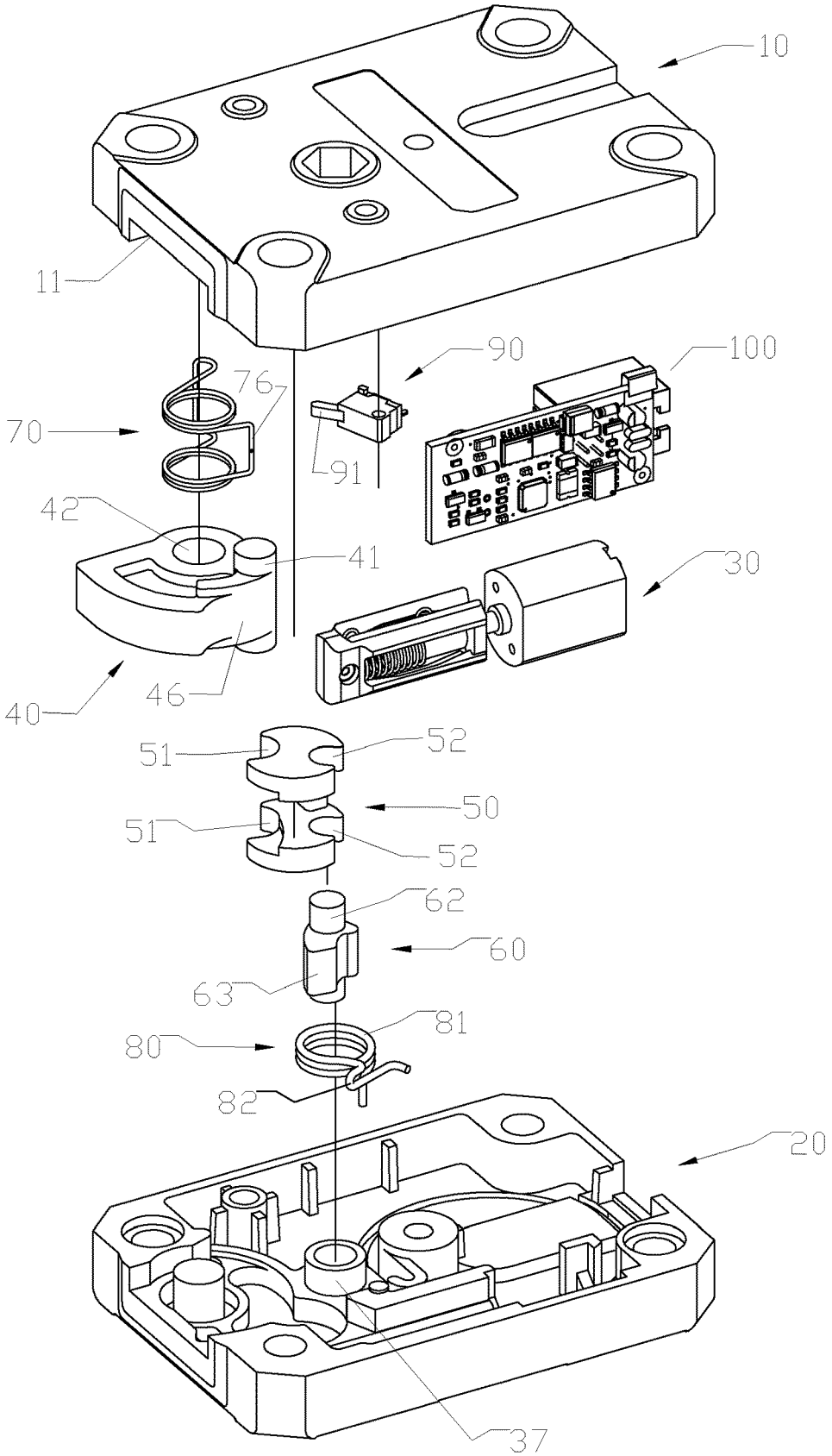
Figure 13:
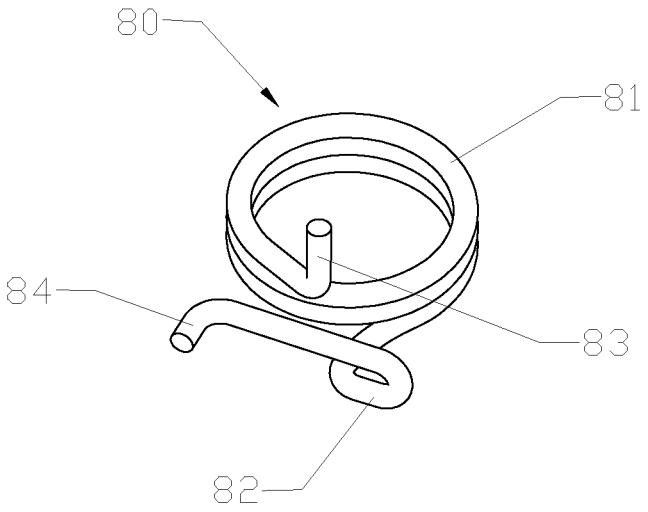
FIG. 13 is a perspective view of a second elastic member of the present invention.

With reference to FIG. 13 for the structure of a second elastic member 80 of a relocking mechanism in accordance with the present invention, the relocking mechanism comprises a second elastic member 80 fixed onto the second casing 20, and the second elastic member 80 is also a bias spring made by winding a spring wire, and an end of the third coil spring 81 of the bias spring is extended along the tangent of the outer periphery of the coil spring and then bent into a U-shaped stop portion 82, and the reentry part of the U-shaped stop portion 82 is further extended and bent into an L-shaped hook 84 formed at a free end of the stop portion 82, and the other end of the third coil spring 81 is bent 90 degrees with respect to the axial direction of the coil spring and formed into a free end 83 of the third coil spring. In FIGS. 2 and 9, the cam dog shaft 37 installed onto the second casing 20 is proximate to the first basin 13, and the third coil spring 81 is sheathed on the cam dog shaft 37 for free rotation (without being biased), and the cam dog shaft 37 has a location hole 23 formed thereon for inserting the free end 83 of the third coil spring 81, and the third flange 22 fixed to the L-shaped hook 84 is disposed at an edge of the guard slot 18 of the second casing 20, and the third flange 22 is extended from the sealed area of the guard slot 18 and across the inverted L-shaped hook of the guard slot, and such inverted L-shaped hook is configured to be corresponsive and cooperative with the L-shaped hook 84 at the free end of the stop portion. After the L-shaped hook 84 is hooked to the third flange, the third coil spring 81 is biased. Now, the stop portion 82 of the second elastic member 80 is aligned precisely with the lower edge of the swing post beam 56 (the lower edge falls within the range of the swing post second opening 53).

Figure 14:
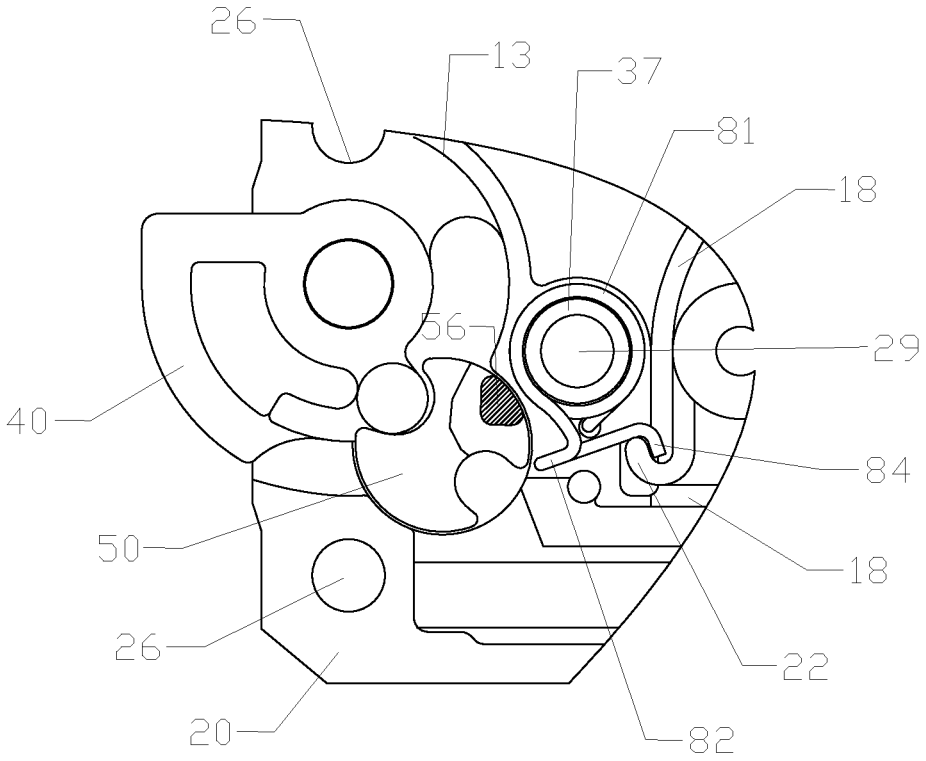
FIGS. 14 and 15 are schematic views of a relocking mechanism of the present invention before and after its operation respectively.

With reference to FIG. 14 for the status before the relocking mechanism is operated, all structures including the first basin 13, the cam dog shaft 37, and the swing post 50 except the third flange 22 are disposed outside the guard slot 18 (or on the left side of the guard slot 18 as shown in FIG. 14), and the second elastic member 80 is biased in advance, and the stop portion 82 is aligned precisely with the third notch of the swing post 50 (which is the area of the second opening at the lower edge of the third notch). In normal situation, the second elastic member 80 does not move, take action, or interfere the normal locking and unlocking of the lock.

Figure 15:
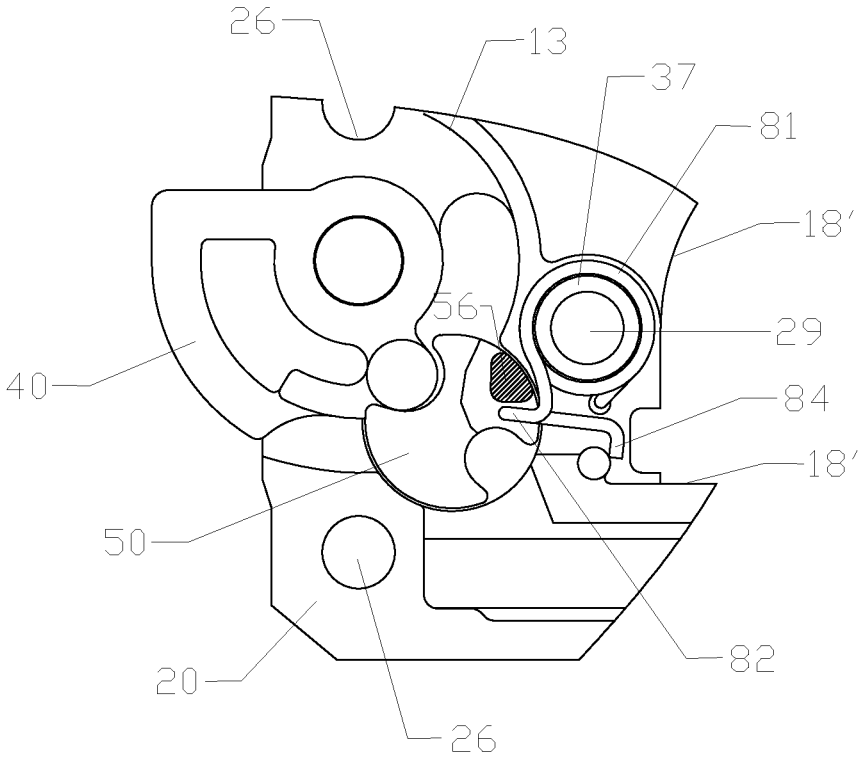

With reference to FIG. 15 for the status after the relocking mechanism is operated, when the lock housing encounters an inevitable damage (such as hammering the bore as described in the background of the present invention), the sealed area of the guard slot 18 of the second casing 20 or the first casing 10 will be broken or fallen off, and the broken area on the right side of the guard slot 18 cannot be seen in FIG. 15, but the edge 18' formed after the guard slot 18 is broken can be seen. Since the third flange 22 is situated in the broken area, therefore the third flange 22 will be fallen off as well. The L-shaped hook 84 of the second elastic member 80 will be released from the third flange 22, and the biased third coil spring 81 will be released, so that the stop portion 82 will enter into the lower edge of the swing post beam 56 to block and prevent the swing post 50 from rotating clockwise. As a result, the lock bolt 40 is prevented from switching its locked position to the unlocked position to achieve the relocking function when the lock is attacked by external forces. In this preferred embodiment of the present invention, the housing, swing post and cam dog are symmetrical structures, and the two guard slots formed on two half casings are also symmetrical. Regardless of which side of the lock is attached and installed to the door panel, the half lock housing will be cracked or broken from the guard slots by the external force when the bore of the lock is attacked by a tool such as hammer, so that the stop portion 82 of the second elastic member will enter into the swing post 50. In the present invention, both surfaces of the lock have the same ability of resisting destructive attack. In other words, the destructive resistance of the lock is not affected by the way of installing the lock.

In FIGS. 1, 3 and 4, the swing post 50 further includes a position switch 90 installed thereon and provided for obtaining the unlocked and locked statuses of the lock bolt 40 through the operating status of the swing post 50. In this preferred embodiment, the position switch 90 is a micro switch. The micro switch has an elastic contact arm 91, so that when the elastic contact arm 91 is flipped slightly, the micro switch will be turned off or disconnected. The micro switch is fixed onto the first casing 10 and its height will not exceed the combining surface of the first casing 10 after installation. The switched elastic contact arm 91 is biased on the swing post beam 56, so that when the lock bolt 40 is switched from the locked position to the unlocked position, the swing post 50 is pushed to rotate for an angle, and the switched elastic contact arm 91 exits from the support of the beam 56 and enters into the third notch (or the lower edge of the beam) and moves downwardly to resume its free status. In the meantime, the ON/OFF status is changed. On the other hand, when the lock bolt 40 is switched from the unlocked position back to the locked position, the swing post 50 is pushed to rotate backward, and the beam 56 will push the switched elastic contact arm 91 to move from the position at the lower edge of the beam 56 to the beam 56, so as to resume the bias status of the elastic contact arm 91, and the ON/OFF status is changed again. It is noteworthy that the positions of the second elastic member 80 and position switch 90 are staggered along the thicknesswise direction of the housing and will not interfered with each other. In addition, the third shaft 38 of the housing has three vertical ribs 28 to limit the axial displacement of the second elastic member 80, and the end surface of the vertical rib is aligned evenly with the end surface of the third shaft to form a boss capable of blocking the axial displacement of the third coil spring 81.

While the invention has been described by means of specific embodiments, numerous modifications and variations could be made thereto by those skilled in the art without departing from the scope and spirit of the invention set forth in the claims.

What is claimed is:

1. A swing bolt lock, comprising:

a housing with at least one first opening, including a first casing, a second casing, a lock bolt connected to a rotatable handle capable of turning out from the first opening to a locked position and turning to an unlocked position, a locking device capable of controlling and stopping the lock bolt from turning out from the locked position to the unlocked position, and a first elastic element capable of restoring the lock bolt from the unlocked position to the locked position, characterized in that the locking device comprises:

a swing post connected to the lock bolt, a cam dog connected to the swing post, an electric device, a first basin formed in the housing and capable of accommodating the swing post and allowing the swing post to be rotated therein, a first shaft slot and a second shaft slot formed on the swing post, a first bolt shaft installed onto the lock bolt and configured to correspond to the first shaft slot, and a cam dog shaft installed onto the cam dog and configured to correspond to the second shaft slot;

the electric device is electrically connected to an external unlock authorization device capable of receiving an unlock authorization and comprises:

a motor, a slider coupled to a transmission shaft of the motor, the slider being received in a sliding slot inside the housing and capable of sliding in the sliding slot, wherein, the slider at the locked position is situated in the space at an end of the sliding slot and abuts against the cam dog to stop the lock bolt from turning into the housing;

after the unlock authorization is received, the motor drives the slider to be separated from and to abut against the cam dog, and after an external torque is exerted onto the rotatable handle, the swing post is pushed, and the swing post further pushes the cam dog, so that the cam dog is turned into a space at an end of the sliding slot previously occupied by the slider, and the lock bolt is turned to the unlocked position.

2. The swing bolt lock of claim 1, wherein the swing post comprises two coaxial symmetrical cylinders, a beam coupled to the two cylinders, and a second opening formed between the two cylinders and capable of accommodating a part of the lock bolt and a part of the cam dog, and the first shaft slot and the second shaft slot are parallelly disposed on the cylindrical surfaces of the two cylinders respectively, and the first bolt shaft is symmetrically installed on the two planes of the lock bolt, and the cam dog is in the shape of a partial ring body, and the cam dog shaft is symmetrically installed on the two planes of the ring body.

3. The swing bolt lock of claim 2, wherein the beam is installed at a position deviated from the center of the cylinder, and the joint surface of the beam and the cylindrical surface of the two cylinders are disposed on the same cylindrical surface, and the beam has a length greater than the thickness of the lock bolt, and the cam dog has a thickness equal to the thickness of the lock bolt.

4. The swing bolt lock of claim 2, wherein the first shaft slot and the second shaft slot are semicircular slots, and the first shaft slot and the second shaft slot on the cylindrical surface of the swing post have an angular difference from 170 degrees to 190 degrees.

5. The swing bolt lock of claim 2, wherein the cam dog includes a cam dog head and a downwardly curved cam dog tail, and when the lock bolt is situated at the locked status, the cam dog head and the slider head abut against each other and the cam dog further includes a first flange formed inside the housing and abutting against the cam dog tail.

6. The swing bolt lock of claim 2, wherein the lock bolt has a protruding arc strip symmetrically disposed on the two planes of the lock bolt separately, and the swing post has a recessed arc surface disposed at a corresponding position configured to be corresponsive to the arc strip.

7. The swing bolt lock of claim 1, wherein the lock bolt is fan-shaped, and the included angle of the fan shape is 80 degrees to 100 degrees, and the lock bolt has a first axial hole, and the housing has a first bolt shaft slidably coordinated with the first axial hole, and the first elastic element is a bias spring sheathed on the first bolt shaft, and the bias spring has an end fixed to a second flange in the housing, and the other end fixed to a neck at an end of the lock bolt.

8. The swing bolt lock of claim 7, wherein the bias spring includes two symmetrically installed coil springs respectively: a first coil spring and a second coil spring integrally formed as a whole, and outer ends of the first coil spring and second coil spring are extended along the tangent of the coil springs and then bent into a hook which is a first hook of the second flange, and inner ends of the first coil spring and second coil spring are extended along the tangent of the coil springs and then bent into a right angle to for a second hook, and the distance between the inner sides of the first coil spring and second coil spring can accommodate the thickness of the lock bolt.

9. The swing bolt lock of claim 1, further comprising symmetric first openings, first basins and sliding slots disposed in the first casing and second casing and also comprising symmetric lock mounting holes formed in the first casing and second casing.

10. The swing bolt lock of claim 1, wherein the first casing and the second casing have the same thickness.

11. The swing bolt lock of claim 9, further comprising identical lock mounting holes formed at the four corners of the first casing and second casing respectively, and the lock mounting hole have the same sink hole, so that any one of the two sides of the lock may be selected to be installed and contacted with the door panel.

12. The swing bolt lock of claim 11, further comprising a fifth lock mounting hole formed at positions of the first casing and second casing respectively and disposed at positions proximate to the first basin.

13. The swing bolt lock of claim 1, wherein the first casing has at least two circular truncated cone shaped convex stop openings coaxially arranged with the lock mounting holes, and the second casing has a circular truncated cone shaped concave stop opening formed at a position corresponsive to the circular truncated cone shaped convex stop opening.

14. The swing bolt lock of claim 13, further comprising a ring-shaped lead slot formed at the motor and disposed around the circular truncated cone shaped convex stop opening.

15. The swing bolt lock of claim 1, further comprising a symmetric guard slot formed at the first casing and the second casing, and a portion of the housing with the guard slot being broken first when the housing is damaged by external forces, and the swing bolt lock further comprising a relocking device, and the relocking mechanism including a second elastic member, and a third notch formed on the swing post and configured to be corresponsive to the second elastic member, and when the housing is damaged, the second elastic member entering into the third notch to block and prevent the swing post from rotating when a portion of the housing sealed by the guard slot is cracked.

16. The swing bolt lock of claim 15, further comprising a third flange formed in the guard slot of the second casing, a cam dog shaft installed outside the guard slot of the second casing, and a location hole formed at a position proximate to the cam dog shaft, and the second elastic member comprising a third coil spring, a stop portion, an extension, and a free end of the third coil spring and a free end of the extension, and the third coil spring being sheathed on the cam dog shaft, and the free end of the third coil spring being fixed to the location hole, and the hook at the free end of the extension being disposed on the third flange to deviate the third coil spring, and the stop portion is configured to be corresponsive to the third notch of the swing post.

17. The swing bolt lock of claim 16, wherein the second elastic member is a whole piece made of a spring wire, and the stop portion is in a U-shape, and the free end of the extension is an L-shaped hook, and the cross-sectional shape of the third flange is an inverted L-shaped hook latched with the L-shaped hook, and the housing has a boss configured to be corresponsive to the third coil spring for limiting the axial movement of the third coil spring.

18. The swing bolt lock of claim 1, further comprising a position switch provided for detecting a rotational entrance or exit of the lock bolt, and an elastic contact arm of the position switch elastically touches and presses a beam of the swing post, and when the lock bolt is turned into a position, the elastic contact arm is separated from the beam to change an ON/OFF electrical signal.

* * * * *